US006809325B2

(12) United States Patent
Dahl et al.

(10) Patent No.: US 6,809,325 B2
(45) Date of Patent: Oct. 26, 2004

(54) APPARATUS FOR GENERATING AND SELECTING IONS USED IN A HEAVY ION CANCER THERAPY FACILITY

(75) Inventors: Ludwig Dahl, Darmstadt (DE); Bernhard Schlitt, Darmstadt (DE)

(73) Assignee: Gesellschaft fuer Schwerionenforschung mbH, Darmstadt (DE)

( * ) Notice: Subject to any disclaimer, the term of this patent is extended or adjusted under 35 U.S.C. 154(b) by 0 days.

(21) Appl. No.: 10/470,464

(22) PCT Filed: Feb. 5, 2002

(86) PCT No.: PCT/EP02/01167

§ 371 (c)(1),
(2), (4) Date: Nov. 12, 2003

(87) PCT Pub. No.: WO02/063637

PCT Pub. Date: Aug. 15, 2002

(65) Prior Publication Data

US 2004/0069958 A1 Apr. 15, 2004

(30) Foreign Application Priority Data

Feb. 5, 2001 (EP) ..... 01102192
Feb. 5, 2001 (EP) ..... 01102194

(51) Int. Cl.[7] ..... G21G 5/00
(52) U.S. Cl. ..... 250/492.3; 250/492.1
(58) Field of Search ..... 250/396 R, 396 ML, 250/397, 492.1, 492.3

(56) References Cited

U.S. PATENT DOCUMENTS 4,870,287 A 9/1989 Mills et al.
5,037,602 A * 8/1991 Dabiri et al. ..... 376/198
5,675,606 A 10/1997 Burns et al.

OTHER PUBLICATIONS

Eickhoff H et al.: "The proposed accelerator facility for light ion cancer therapy in Heidelberg" *Proceedings of the 1999 Particle Accelerator Conference* (*Cat. No. 99CH36366*), *Proceedings of the 1999 Particle Accelerator Conference, New York, NY, USA, Mar. 27–Apr. 2, 1999,* pp. 2513–2515.

Peters A et al.: "Beam diagnostics for the heavy ion cancer therapy facility" *Beam Instrumentation Workshop 2000 Ninth Workshop, Cambridge, MA, USA May 8–11, 2000,* No. 546, pp. 519–526.

Sawada K et al.: "Performance test of electron cyclotron resonance ion sources for the Hyogo ion Beam Medical Center" *Proceedings of 8th International Conference on ion Sources* (*ICIS'99*), *Kyoto, Japan Sep. 6–10, 1999,* vol. 71, No. 2, pt. 1–2, pp. 987–989.

Muramatsu M et al.: "Status of 2.45 GHz compact National Institute of Radiological Sciences electron cyclotron resonance ion source" *7th International Conference on ion Sources, Taorimina, Italy Sep. 7–13, 1997,* vol. 69, No. 2, pp. 1076–1078.

* cited by examiner

*Primary Examiner*—Nikita Wells
*Assistant Examiner*—Erin-Michael Gill
(74) *Attorney, Agent, or Firm*—Frommer Lawrence & Haug LLP; Ronald R. Santucci

(57) ABSTRACT

The present invention relates to an apparatus for generating, extracting and selecting ions used in a heavy ion cancer therapy facility. The apparatus comprises an independent first (ECRIS 1) and an independent second electron cyclotron resonance ion source (ECRIS 2) for generating heavy and light ions, respectively. Further is enclosed downstream of spectrometer magnet (SP1, SP2) for selecting heavy ion species of one isotopic configuration positioned downstream of each ion source (ECRIS 1, ECRIS 2): a magnetic quadrupole triplet (QT1, QT2) positioned downstream of each spectrometer magnet (SP1, SP2); a switching magnet (SM) for switching between high-LET ion species and low-LET ion species of said two independent first and second ion source.

6 Claims, 3 Drawing Sheets

APPARATUS FOR GENERATING AND SELECTING IONS USED IN A HEAVY ION CANCER THERAPY FACILITY

This application is a 371 of PCT/EP02/01167 filed on Feb. 5, 2002, published on Aug. 15, 2002 under publication number WO 02/063637 A1 which claims priority benefits from European patent application number EP 01 102 192.0 filed Feb. 5, 2001 and European patent application number EP 01 102 194.6 filed Feb. 5, 2001.

The present invention relates to an apparatus generating and selecting ions used in a heavy ion cancer therapy facility according to independent claims.

From U.S. Pat. No. 4,870,287 a proton beam therapy system is known for selectively generating and transporting proton beams from a single proton source. The disadvantage of such a system is, that the flexibility to treat patients is quite limited to relatively low effective proton beams.

It is an object of the present invention to provide an improved apparatus for generating and selecting different ions useful in an ion beam cancer therapy facility.

This object is achieved by the subject matter of independent claim 1. Features of preferred embodiments are defined by dependent claims.

According to the invention an apparatus is provided for generating, extracting and selecting ions used in an ion cancer therapy facility. The apparatus comprises an independent first and an independent second electron cyclotron resonance ion source for generating heavy and light ions, respectively. Further is enclosed a spectrometer magnet for selecting heavy ion species of one isotopic configuration positioned downstream of each ion source; a magnetic quadrupole triplet lens positioned downstream of each spectrometer magnet; a switching magnet for switching between high-LET ion species and low-LET ion species of said two independent first and second ion sources. An analyzing slit is located at the image focus of each spectrometer magnet and a beam transformer is positioned in between the analyzing slit and the magnetic quadrupole triplet.

Such an apparatus has the advantage, that the possibility to help patients is largely improved by providing two independent ion sources and a switching magnet to select the proper ion species for an optimal treatment. Further the apparatus according to the present invention has the additional advantage that two independent spectrometer lines (one for each ion source) increase the selectivity of the apparatus and improve the purity of the ion species by separating with high accuracy the ion species selected for acceleration in the linac from all the other ion species extracted simultaneously from the ion sources.

For the intensity controlled rasterscannner ion beam application system different beam intensities within an intensity range of 1/1000 are provided in a preferred embodiment of the invention for each individual synchrotron cycle. The apparatus according to the present invention has the advantage to control the beam intensity at a low energy level in that the beam is destroyed along a low energy beam transport (LEBT) line in between the magnetic quadrupol triplet and an radio frequency quadrupole accelerator (RFQ). In particular, irises with fixed apertures are provided after a switching magnet as well as before and after a macropole chopper and at an RFQ entrance flange. An intensity measurement of the relative intensity reduction versus the magnet current of the center quadrupole of the magnet quadrupole triplet lens downstream of the image slit of the spectrometer is carried out for the apparatus of the present invention and shows that the beam intensity is reduced by about a factor of 430 starting from the default setting of the quadrupole magnet down to zero current. A further reduction of the beam intensity leading to a degradation factor of 1000 can be achieved by an additional reduction of the field of the third quadrupole of the magnetic quadrupole triplet. A very smooth curve is obtained, providing a good reproducibility of the different intensity levels.

Therefore, the present invention avoids unnecessary radioactive contamination of the machine since beam intensity is controlled at the lowest possible beam energy, i.e. in said low energy beam transport line. Because the synchrotron injection scheme is not changed for the different beam intensity levels, i.e. the number of turns injected into the synchrotron are the same in all cases, the full dynamic range of 1000 is provided by the intensity control scheme in the LEBT according to the present invention. In the apparatus of the present invention the beam loss occurs mainly in the LEBT, i.e. the relative intensity reduction is almost the same measured directly behind the LEBT at a low energy level and measured in the Therapy beam line at an high energy level.

Furthermore, beam profiles are measured at different locations along the accelerator chain and at the final beam delivery system of the therapy beam line. No differences could be observed in the beam profiles as well as in the beam positions for the different beam intensities. This is a very important advantage of the present invention in order to provide reliable and constant and not intensity dependent beam parameters at the treatment locations particularly when the when the apparatus of the present invention is applied for a heavy ion cancer therapy facility.

The beam transformer positioned in between the analyzing slit and the magnetic quadrupole triplet has the advantage to measure and monitor one-line the ion beam current of the ion species selected for acceleration without destroying the ion beam. Because this transformer is positioned upstream of the magnetic quadrupole triplet used for the intensity reduction the beam transformer monitors continuously the non-degraded ion beam current while intensity of the linear accelerator beam can be changed from pulse to pulse using triplet magnets. This is very important for an on-line monitoring of the performance of the selected ion source.

In a first preferred embodiment a solenoid magnet is located at the exit of each ion source. This embodiment of the present invention has the advantage that the ion beams extracted of each ion source are focused by a solenoid magnet into the object point of the spectrometer.

In an other preferred embodiment a magnetic quadrupole singlet is positioned downstream of each ion source. This quadrupole singlet has the advantage to increase the resolution power of each spectrometer system and to provide a flexible matching between the ion sources and the spectrometer systems.

In a further preferred embodiment the ion sources comprise exclusively permanent magnets. These permanent magnets provide a magnetic field for the ion sources and have the advantage that no magnet coils are required, which would have a large power consumption for each ion source. Additionally to the large power consumption these magnet coils have the disadvantage, that they need a high pressure water cooling cycle, which is avoided in the case of permanent magnets within the ion sources of the present invention. This has the advantage to reduce the operating costs and increase the reliability of the apparatus of the present invention.

A further preferred embodiment of the present invention comprises beam diagnostic means which are located upstream each spectrometer magnet. Such beam diagnostic means can measure the cross-sectional profile of the beam and/or the totally extracted ion current. Said beam diagnostic means preferably comprises profile grids and/or Faradays cups.

A further embodiment of the present invention provides a beam diagnostic means located at each image slit. This embodiment has the advantage to measure the beam size and beam intensity for different extracted ion species and to record a spectrum.

In a preferred embodiment of the invention, said focusing solenoid magnet is positioned downstream of said macropulse chopper and upstream of said radiofrequency quadrupole accelerator. This has the advantage that the beam is focused by the solenoid magnet directly to the entrance electrodes of the radio frequency quadrupole within a very short distance between the solenoid lens and the beginning of the RFQ electrodes of about 10 cm.

A further preferred embodiment of the present invention provides diagnostic means comprising a Faraday cup and/or profile grids within the low energy beam transport system (LEBT) downstream of a switching magnet. These diagnostic means are not permanently within the range of the ion beam, but are positioned into the range of the ion beam for measurement purposes. The Faraday cup captures all ions passing the switching magnet and the profile grids measure the local distribution of ions within the beam cross section. During an operation cycle these diagnostic means are driven out of the range of the ion beam.

In a further preferred embodiment of the present invention the alternating stems within said radio frequency quadrupole are mounted on a common water cooled base plate. This has the advantage that the energy loss of the RFQ is conducted toward to outside of the chamber and do not damage the stems or the electrodes of the RFQ.

In a further preferred embodiment of the present invention the base plate is made of an electrical insulating material. This has the advantage that the stems are not short circuit, though they are acting as inductivity whilst said mini-vane pairs forming electrodes are acting as capacitance for a $\lambda/2$ resonance/structure.

The invention is now explained with respect to embodiments according to the subsequent drawings.

Figure 3:
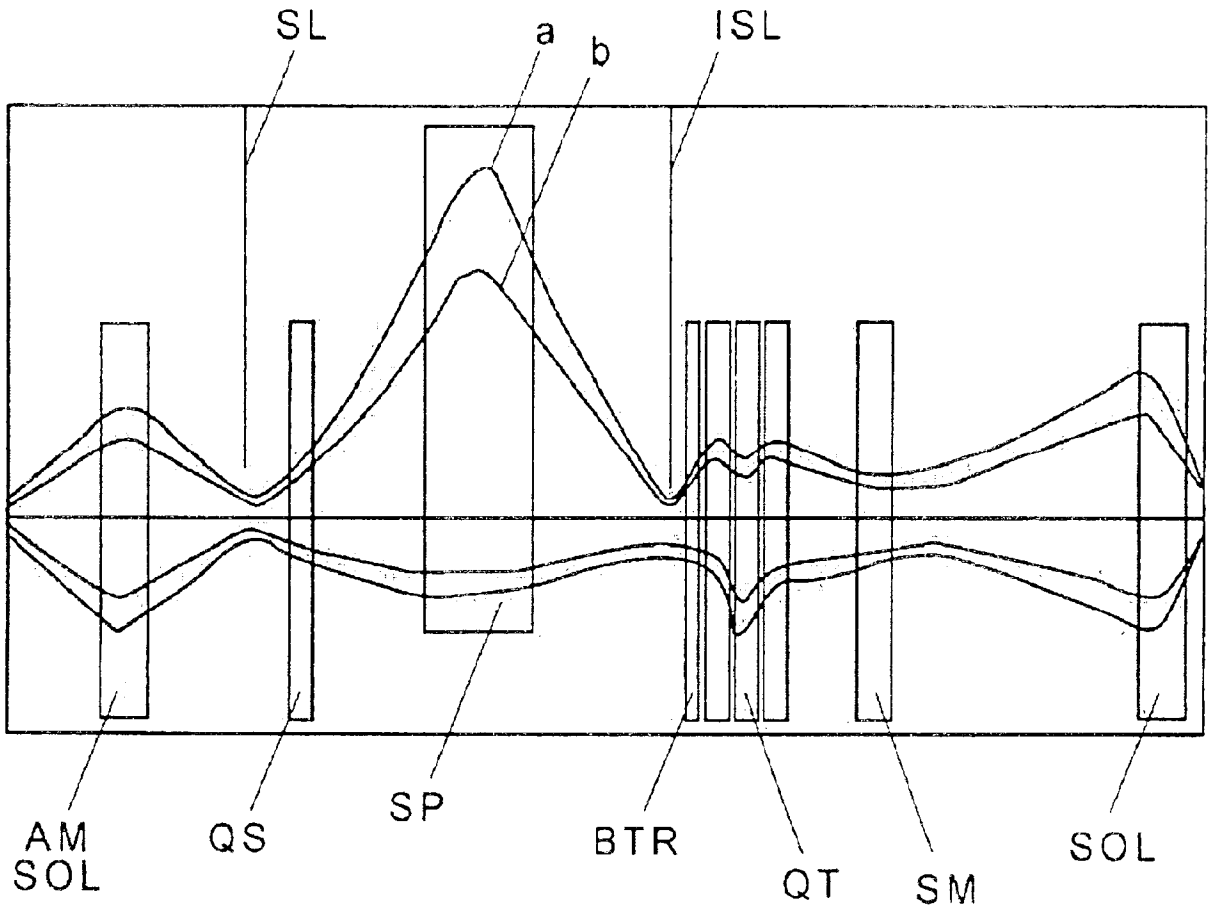

FIG. 3 shown examples for beam envelopes of an apparatus for generating and selecting ions and along a low energy beam transport line.

Figure 1:
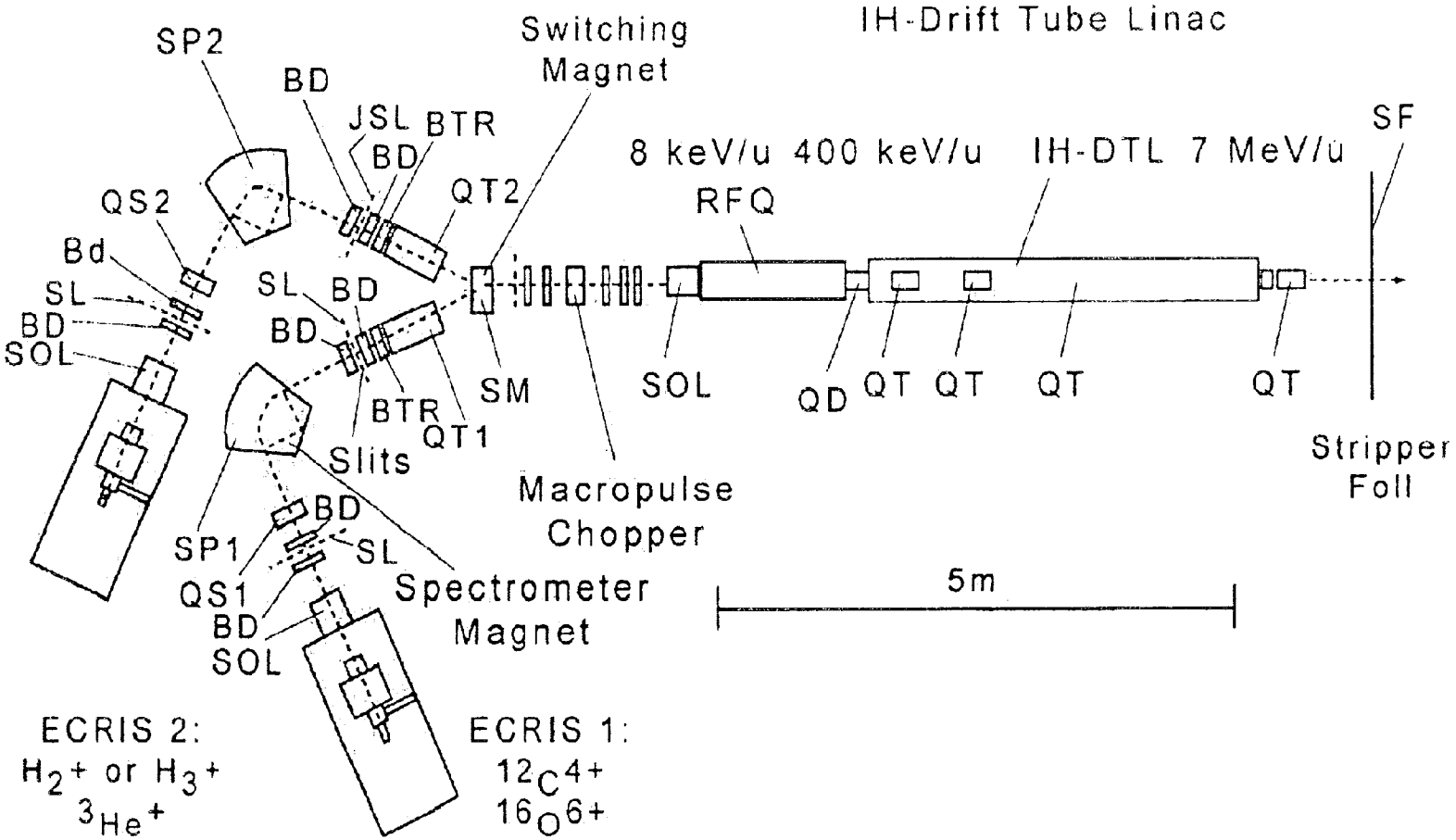
FIG. 1 shows a schematic drawing of a complete injector linear accelerator for an ion beam application system comprising an apparatus for generating and selecting ions used in a heavy ion cancer therapy facility.
Figure 2:
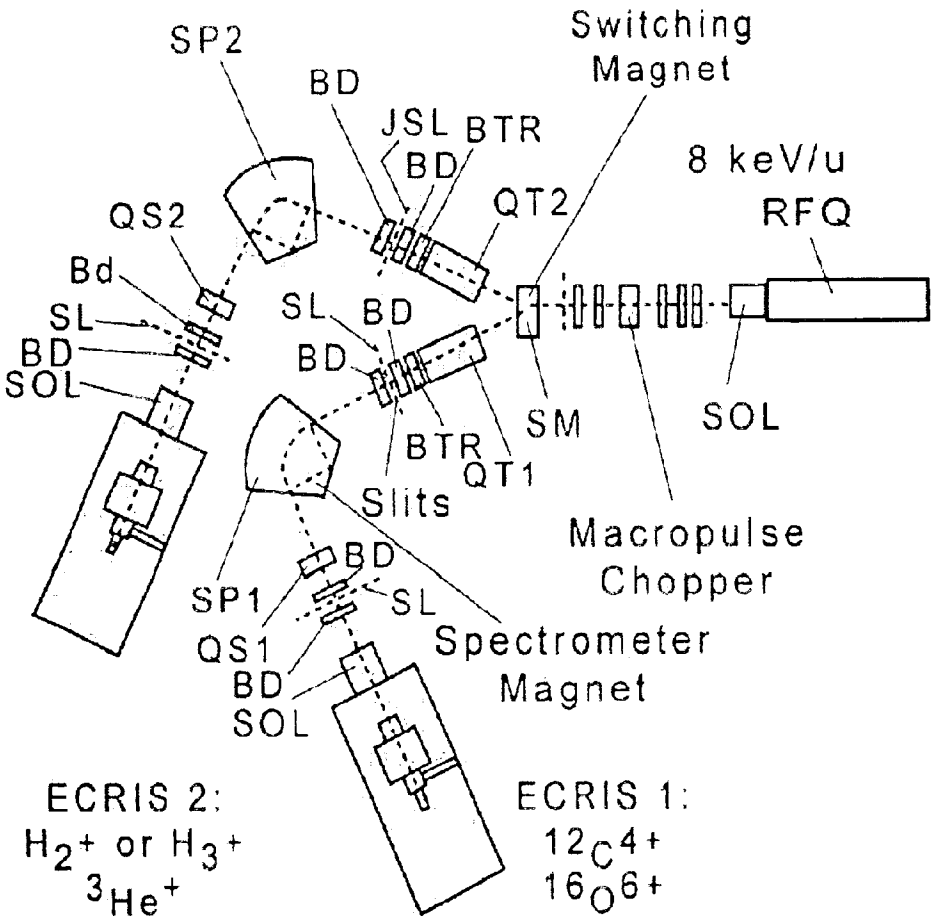
FIG. 2 shows a schematic drawing of FIG. 1 in detail.

The reference signs within FIGS. 1, 2 and 3 are defined as follows:

| | |
|---|---|
| ECRIS1 | First electron cyclotron resonance ion sources for heavy ions like $^{12}C^{4+}$ or $^{16}C^{6+}$ |
| ECRIS2 | Second electron cyclotron resonance ion sources for light ions like $H_2^+$, $H_3^+$, or $^3He^+$ |
| SOL | Solenoid magnet at the exit of ECRIS1 and ECRIS2 |
| BD | Beam diagnostic block comprising profile width and/or Faradays cups |
| SL | Collimator slit |
| ISL | Collimator image slit |
| BTR | beam transformer |
| QS1 | Magnetic quadrupole singlets of first and |
| QS2 | second branch |

-continued

| | |
|---|---|
| QD | Quadrupole doublet |
| QT | Magnetic quadrupole triplet |
| SP1 | Spectrometer magnet of first and |
| SP2 | second branch |
| SM | Switching magnet |
| CH | Macropulse chopper |
| RFQ | Radio-frequency quadrupole accelerator |
| IH-DTL | IH-type drift-tube linac |
| SF | Stripper foil |
| a) (FIG. 3) | Beam envelopes according to a beam emittance of 120 $\pi$ mm mrad |
| b) (FIG. 3) | Beam envelopes according to a beam emittance of 240 $\pi$ mm mrad |

The tasks of the different sections of FIG. 1 and FIG. 2 of an apparatus for generating and selecting ions to supply an injector system and the corresponding components can be summarized in the following items:

1. The production of ions, pre-acceleration of the ions to a kinetic energy of 8 keV/u and formation of ion beams with sufficient beam qualities are performed in two independent ion sources and the ion source extraction systems. For routine operation, one of the ion sources can deliver a high-LET ion species ($^{12}C^{4+}$ and $^{16}O^{6+}$, respectively), whereas the other ion source may produce low-LET ion beams ($H_2^+$, $H_3^+$ or $^3He^{1+}$).
2. The charge states to be used for acceleration in the injector linac are separated in two independent spectrometer lines. Switching between the selected ion species from the two ion source branches, beam intensity control (required for the intensity controlled raster-scan method), matching of the beam parameters to the requirements of the subsequent linear accelerator and the definition of the length of the beam pulse accelerated in the linac are done in the low-energy beam transport (LEBT) line.
3. The linear accelerator consists of a short radio-frequency quadrupole accelerator (RFQ) of about 1.4 m in length, which accelerates the ions from 8 keV/u to 400 keV/u, a compact beam matching section of 0.25 m in length and a 3.8 m long IH-type drift-tube linac (IH-DTL) for effective acceleration to the linac end energy of 7 MeV/u.
4. Remaining electrons are stripped off in a thin stripper foil located about 1 m behind of the IH-DTL to produce the highest possible charge states before injection into the synchrotron in order to optimize the acceleration efficiency of the synchrotron (Table 1).

TABLE 1 shows charge states of all proposed ion species for acceleration in the injector linac (left column) and behind of the stripper foil (right column)

| Ions from source | Ions to synchrotron |
|---|---|
| $^{16}O^{6+}$ | $^{16}O^{8+}$ |
| $^{12}C^{4+}$ | $^{12}C^{6+}$ |
| $^3He^{1+}$ | $^3He^{2+}$ |
| $^1H_2^+$ or $^1H_3^+$ | protons |

The design of the apparatus for generating and selecting ions and the injector system of the present invention has the advantage to solve the special problems on a medical machine installed in a hospital environment, which are high reliability as well as stable and reproducible beam parameters. Additionally, compactness, reduced operating and maintenance requirements. Further advantages are low investment and running costs of the apparatus.

Both the RFQ and the IH-DTL are designed for ion mass-to-charge ratios A/q≦3 (design ion $^{12}C^{4+}$) and an operating frequency of 216.816 MHz. This comparatively high frequency allows to use a quite compact LINAC design and, hence, to reduce the number of independent cavities and RF power transmitters. The total length of the injector, including the ion sources and the stripper foil, is around 13 m. Because the beam pulses required from the synchrotron are rather short at low repetition rate, a very small rf duty cycle of about 0.5% is sufficient and has the advantage to reduce the cooling requirements very much. Hence, both the electrodes of the 4-rod-like RFQ structure as well as the drift tubes within the IH-DTL need no direct cooling (only the ground plate of the RFQ structure and the girders of the IH structure are water cooled), reducing the construction costs significantly and improving the reliability of the system.

To provide very stable beam currents without any pronounced time structures as well as high beam quality an Electron Cyclotron Resonance Ion Source (ECRIS) is used for the production of $^{12}C^{4+}$ and $^{16}O^{6+}$ ions (ECRIS 1 in FIG. 1 and FIG. 2). For the production of proton and helium beams two different ion source types can be used. Either an ECR ion source of the same type as used for the production of the high-LET ion beams will be applied here as well (ECRIS 2 in FIG. 1 and FIG. 2) or a special low-cost, compact, high brilliance filament ion source may be used.

In case of an ECR ion source, molecular $H_2^+$ ions will be produced in the ion source and used for acceleration in the linac. In case of the filament source, $H_3^+$ ions are proposed, providing the same mass-to-charge ratio of A/q=3 as of the $^{12}C^{4+}$ ions. For production of the helium beam, $^3He^{1+}$ ions will be extracted from the source in both cases. To avoid contaminations of the beam with other light ions produced simultaneously in the ion source, $^3He$ is proposed instead of $^4He$.

The maximum beam intensities discussed for the synchrotron are about $10^9$ $C^{6+}$ ions per spill at the patient. Assuming a multi-turn injection scheme using 15 turns at 7 MeV/u, a bunch train of about 25 μm length delivered by the LINAC is injected into the synchrotron. Taking into account beam losses in the synchrotron injection line, the synchrotron and the high energy beam line, this corresponds to a LINAC output current of about 100 eμA $C^{6+}$. Considering further beam losses in the LEBT, the LINAC and the stripper foil, a minimum $C^{4+}$ current of about 130 eμA extracted out of the ion source is required. The minimum ion currents required for all ion species discussed here are listed in Table 2 (called $I_{min}$).

However, the ion sources taken into consideration should be tested with an ion current including a safety margin of at least 50%. These values are called $I_{safe}$ in Table 2 and range between 150 eμA for $^{16}O^{6+}$ and 1 emA for $H^{2+}$. For the sake of stability, DC operation is proposed for the ECR ion sources.

TABLE 2 shows parameters for extraction voltages and ion currents extracted out of the ion sources of the present invention for different ion species.

| Ion | A/q | $U_{ext}$/kV | $I_{min}$/μA | $I_{safe}$/μA |
|---|---|---|---|---|
| $^{16}O^{6+}$ | 2.66 | 21.3 | 100 | 150 |
| $^{12}C^{4+}$ | 3 | 24 | 130 | 200 |
| $^3HE^{1+}$ | 3 | 24 | 320 | 500 |

TABLE 2-continued shows parameters for extraction voltages and ion currents extracted out of the ion sources of the present invention for different ion species.

| Ion | A/q | $U_{ext}$/kV | $I_{min}$/μA | $I_{safe}$/μA |
|---|---|---|---|---|
| $^3HE^{2+}$ | 2 | 12 | 640 | 1000 |
| p | 1 | 8 | 1300 | 2000 |
| $^1H_2^+$ | 2 | 16 | 650 | 1000 |
| $^1H_3^+$ | 3 | 24 | 440 | 700 |

For the extraction system, a diode extraction system consisting of a fixed plasma electrode and a single moveable extraction electrode is proposed for the ECR ion sources. The extraction voltages $U_{ext}$ necessary for a beam energy of 8 keV/u are also listed in Table 2. In case of $^{12}C^{4+}$ and $^3He^{1+}$ extraction voltages of 24 kV are required. In case of a proton beam delivered directly from the ion source, the required extraction voltage of 8 kV would be rather small to achieve a proton current of 2 mA. Furthermore, significant space-charge problems have to be handled within the low-energy beam transport line and the RFQ accelerator in such a case. Hence, the production and acceleration of molecular $H_2^+$ and $H_3^+$ ions, respectively, is proposed.

The independent first and second electron cyclotron resonance ion sources (ECRIS1 and ECRIS2) provide a very well suited solution for an injector linac installed at a hospital, the magnetic fields are provided exclusively by permanent magnets. This has the large advantage that no electric coils are required, which would have a very large power consumption of up to about 120 kW per ion source. In addition to the large power consumption, the coils have the disadvantage to need an additional high-pressure (15 bar) water cooling cycle, which is not as safe as the permanent magnet ion sources of the present invention. Both aspects have the advantage to reduce the operating costs and increase the reliability of the present system.

The main parameters of a suitable high-performance permanent magnet ECRIS of a 14,5 GHz SUPERNANOGAM are listed in Table 3, and are compared to the data of two ECR ion sources using electric coils, which are the ECR4-M (HYPERNANOGAN) and the 10 GHz NIRS-ECR used for routine production of $^{12}C^{4+}$ beams for patient irradiation at HIMAC and at Hyogo Ion Beam Medical Center.

For SUPERNANOGAN, the plasma confinement is ensured by a minimum-B magnetic structure with magnetic parameters quite close to the ECR4-M ones, but with a reduced length of the magnetic mirror (about 145 mm instead of 190 mm) and a smaller diameter of the plasma chamber (44 mm instead of 66 mm). The maximum axial mirror-fields are 1.2 T at injection and 0.9 T at extraction. The weight of the FeNdB permanent magnets amount to roughly 120 kg, the diameter of the magnet body is 380 mm and its length is 324 mm.

For our purpose, SUPERNANOGAN has been tested at an ECR ion source test bench. For all ion species proposed here, the required ion currents could be achieved in a stable DC operating mode using extraction voltages close to the values required for the injector linac and at moderate rf power levels between about 100 W and 420 W. For $O^{6+}$ as well as for $He^{1+}$ even about twice the required currents $I_{safe}$ could be achieved easily. For the production of $^{12}C^{4+}$ $CO_2$ has been used as main gas as also applied at GSI for the production of $^{12}C^{2+}$. Experimental investigations at HIMAC have shown that the yield of $^{12}C^{4+}$ ions can be enhanced significantly using $CH_4$ as main gas. Further improvements of the $C^{4+}$ production performance can be expected for SUPERNANOGAN as well if $CH_4$ would be used as main gas. The measured geometrical emittances of around 90% of the beams range between 110 mm mrad for $^{16}O^{6+}$ and up to 180 mm mrad for $He^{1+}$ and $^{12}C^{4+}$, corresponding to normalized beam emittances of 0.4 to 0.7 mm mrad.

TABLE 3 shows a comparison of some ECR ion sources. ECR4-M ≡ HYPERNANOGAN, values in brackets for ECR4-M are for 18 GHz operation, the other values are for 14.5 GHz operation. For NIRS-ECR, the values in brackets are obtained using an improved sextupole magnet.

| | | SUPER-NANO-GAN | ECR4-M | NIRS-ECR |
|---|---|---|---|---|
| Operating frequency | GHz | 14.5 | 14–18 | 10 |
| Plasma chamber inner Ø | mm | 44 | 66 | 70 |
| Magnets for axial field | | Permanent | Coils | Coils |
| Coil power consumption | kW | — | 120 (180) | 70 |
| Yoke outer length | mm | 324 | 405 | 358 |
| Yoke outer Ø | mm | 380 | 430 | 650 |
| Length of magnetic mirror | mm | ≈145 | ≈190 | ≈200 |
| $B_{max, Injection}$ | T | 1.2 | 1.2 (1.6) | 0.93 |
| $B_{min}$ | T | 0.45 | 0.4 (0.5) | 0.3 |
| $B_{max, Extraction}$ | T | 0.9 | 1.0 (1.35) | 0.72 |
| $B_{Hexapole}$ | T | 1.1 | 1.1 | 0.9 |
| $U_{ext, max}$ (achieved) | kV | 30 | 30 | 25 |
| Measured ion currents: | | | | |
| $C^{4+}$ | μA | 200 | ≧350 | 430 (640) |
| p | mA | >2.1 | | >2 |
| $H_2^+$ | mA | 1.0 | | 1(2.1) |
| $He^{2+}$ | mA | 1.1 | | 1.5–2.1 |
| $O^{6+}$ | μA | 300 | 1000 | |

Two results obtained with ECR4-M for $C^{4+}$ and $O^{6+}$ are also listed in Table 3, demonstrating that the required ion currents can be exceeded by a certain amount. Some ion currents obtained with NIRS-ECR are also listed in Table 3. The values in brackets are obtained with the upgraded version which consists of an improved sextupole magnet. Again, all values exceed the currents required here by a certain amount. The measured normalized beam emittances range from about 0.5 mm mrad for $C^{4+}$ to roughly 1 mm mrad for a 2.1 emA $H^{2+}$ beam. The NIRS-ECR has a number of advantages: For the comparatively light ions proposed for patient irradiation like carbon, helium and oxygen, a 10 GHz ECR source seems to be powerful enough to produce sufficiently high ion currents if the diameter of the plasma chamber is large enough. On the other hand, the confining magnetic field can be smaller at 10 GHz as compared to 14.5 GHz (used for ECR4-M), reducing the power consumption of the electric coils by about 40%. Furthermore, the NIRS-ECR is in operation at HIMAC especially for the production of $^{12}C^{4+}$ beams. Like at the project proposed here, the injection energy at the HIMAC injector is also 8 keV/u and the extraction voltage applied for the production of $^{12}C^{4+}$ beams is 24 kV.

These parameters are the same in the present case. Additionally, a number of improvements have been applied to NIRS-ECR mainly in order to increase the reliability of the source as well as the lifetime of critical source components and the maintenance intervals.

The electron cyclotron resonance ion sources of the present invention comprises:

1. a DC bias system:
   In order to increase the source efficiency for high charge state ions, both SUPERNANOGAN as well as HYPERNANOGAN are equipped with a DC bias system. The inner tube of the coaxial chamber is DC biased at a voltage of about 200–300 V,
2. a gas supply system:
   To ensure a sufficient long-term stability of the extracted ion current, the thermo-valves for the main and the support gas are regulated by suitable thermo-valve controllers. Furthermore, temperature regulated heating jackets are applied to the thermo-valves to stabilize their temperature. Pressure reducers are used between the main gas reservoirs and the thermo-valves.
3. an RF system:
   High power klystron amplifiers with an rf output power of about 2 kW are used (14.5 GHz or 10 GHz depending on the ion source model). To guarantee a high availability, one additional generator is available for substitution in case of a failure of the amplifier in operation. Therefore three generators are provided in case of the present invention for the two ECR ion sources (ECRIS1 and ECRIS2). Fast switching between the individual generators is possible. Remote control of the output power levels of the generators between 0 and maximum power is provided. The output power levels are controlled by active control units to a high stability of $\Delta P/P \leqq 1\%$. The total rf power transmitted from the generators can be reflected by the ion source plasmas in some cases. Hence, the generators of the present invention can be equipped with circulators and dummy loads which are able to absorb the complete power transmitted from the generators without causing a breakdown of the generators. The measurement of the reflected power is possible for routine operation.

Such an ECR ion source is a preferred solution for the production of the highly charged $C^{4+}$ and $O^{6+}$ ion beams for a therapy accelerator. In principle, the same source model can also be used for the production of $H_2^+$ and $He^+$ beams, providing some additional redundancy. Alternatively, a gas discharge ion source especially developed for the production of high-brilliant beams of singly charged ions can be provided for the production of $H_3^+$ and $^3H^{1+}$ beams.

The plasma generator of the source is housed in a water-cooled cylindrical copper chamber of 60 mm in diameter and about 100 mm in length. For plasma confinement, the chamber is surrounded by a small solenoid magnet with a comparatively low power consumption of less than 1 kW. On the back of the chamber, the gas inlet system is mounted, and, close to the axis, a tungsten filament is installed. The front end of the chamber is closed by the plasma electrode, which can be negatively biased with respect to the anode (chamber walls). For ion extraction, a triode system in accel/decel configuration is used. The geometry of the extraction system of the present invention has been carefully optimized (supported by computer simulations) for different extraction voltages around 22 kV and 55 kV.

If the source is operated with hydrogen at small arc currents of ≦10 A, the $H_3^+$ fraction of the beam is as high as about 90% with a minor amount of $H^+$ ions (≦10%) and only a very small fraction of $H_2^+$ ions. The $H^+$ portion increases with increasing arc current. However, for the production of an $H_3^+$ current of a few mA only, an arc power of less than 1 kW at small arc currents of a few amperes is sufficient, providing an ideal solution for the therapy injector. For these parameters, a lifetime of the tungsten filament of roughly 1000 h is expected for DC operation. To further increase the lifetime, a pulsed operation mode of the source is proposed. The stability of the extracted ion current in pulsed mode with a measured beam noise level of only about 1% is even better than for DC operation.

The use of this ion source has a number of economical and technical advantages as compared to an ECR ion source of the state of the art:

1. The investment costs for the gas discharge ion source of the present invention are at least about five times lower than for an ECR ion source (including the RF generator). In addition, the costs for operational maintenance are lower, in particular, compared to an ECR ion source with electrical coils. For example, the klystron of the RF generator for an ECR ion source of the state of the art must be replaced regularly.
2. The use of $H_3^+$ for acceleration in the linac has several advantages: Because it has the same mass-to-charge ratio of A/Q=3 as of the $^{12}C^{4+}$ ions, the linac cavities are operated at the same rf power level in both cases. This ensures a very stable operation of the linac, increasing the reliability of the system. Furthermore, a very fast switching between $^{12}C^{4+}$ and $H_3^+$ beams would be possible. In addition, space-charge problems along the LEBT and the RFQ accelerator are minimized for $H_3^+$ beams as compared to $H_2^+$ or $H^+$ beams.
3. Much higher beam currents are available.
4. High-brilliant ion beams with normalized beam emittances of $\epsilon_n<0.1\pi$ mm mrad, i.e. about one order of magnitude smaller as compared to the $H_2^+$ beams from the ECR ion sources. E.g. a normalized 80% beam emittance of $0.003\pi$ mm mrad was measured for a 9 mA $He^+$ beam at an extraction voltage of 17 kV.

FIG. 3 shows examples for beam envelops of an apparatus for generating and selecting ions and along a low energy beam transport line. In FIG. 3 beam envelopes in horizontal direction (upper part) and vertical direction (lower part) are plotted for two transverse beam emittances of a) $120\pi$ mm mrad ($\epsilon_n=0.50\pi$ mm mrad) and b) $240\pi$ mm mrad ($\epsilon_n=1.0\pi$ mm mrad). The beam emittances are identical in x and y direction and are based on the values measured for the ECR ion sources used in the present invention, which range between about $\epsilon_n\approx0.5$–$0.7\pi$ mm mrad for carbon, oxygen and helium ion beams and up to about $\epsilon_n\approx1.0\pi$ mm mrad for $H_2^+$ beams. The boxes in FIG. 3 mark the different magnets and their aperture radii. The simulations start at an object focus located in the extraction system of the ion source and end at the beginning of the RFQ electrodes.

The beam parameters at the starting point of the simulations are determined by the geometry of the ion source extraction system including the aperture of the plasma electrode as well as by the operating parameters of the ion source, which influence the shape of the plasma surface in the extraction aperture of the plasma electrode. To provide a flexible matching of beam parameters at the starting point of the spectrometer system, i.e. different beam radii, different divergence angles as well as a displacement of the object focus in axial direction, two focusing magnets are used in front of the spectrometer magnets SP1, SP2 as shown in FIG. 1 and FIG. 2.

First of all, the ion beams extracted from each ion source are focused by a solenoid magnet SOL as shown in FIG. 1 and FIG. 2 into the object point of the subsequent spectrometer. The beam size and location in the bending plane of the spectrometer at this point can be defined by a variable horizontal slit (SL). To increase the resolving power of the spectrometer, which is proportional to the maximum horizontal beam size within the bending magnet, and to reduce the vertical beam width along the spectrometer magnets SP1, SP2 a single horizontally defocusing quadrupole magnet QS is located in between the object focus of the spectrometer and the spectrometer magnets SP1, SP2. The subsequent double focusing 90° spectrometer magnets SP1, SP2 have a radius of curvature of 400 mm and edge angles of 26.6°. For ion beams with a mass-to-charge ratio of A/Q=3 and an energy of 8 keV/u, it is excited to 0.1 T only. The theoretical mass resolving power of the system at the following image slit (ISL) of $$\frac{A/Q}{\Delta(A/Q)} \approx 140$$

is sufficient to separate the desired $^{12}C^{4+}$ ions from other charge states and from several other light ions.

Following the image slits ILS as shown in FIG. 1 and FIG. 2, a magnetic quadrupole triplet QT1, QT2 focuses the beams to an almost circular symmetry along the common part of the LEBT between the switching magnet SM and the RFQ.

Finally, a solenoid magnet is focusing the ion beam into a small matched waist at the beginning of the radio frequency quadrupole (RFQ) accelerator. A pair of chopper plates for macro-pulse formation is placed in between the switching magnet And the RFQ.

Beam diagnostic means BD comprise profile grids and Faraday cups which are located behind the extraction system of the ion sources ECRIS1 and ECRIS2 at the object foci of the spectrometers SP1, SP2 and at the image slits ISL. Further beam diagnostic boxes are positioned behind of the switching magnet and upstream of the solenoid magnet in front of the RFQ. For on-line beam current measurements, a beam transformer is provided in each of the ion source branches in front of the magnetic quadrupole triplets QT1 and QT2.

What is claimed is:

1. An apparatus for generating, extracting and selecting ions used in a heavy ion cancer therapy facility comprising:

an independent first (ECRIS 1) and an independent second electron cyclotron resonance ion source (ECRIS 2) for generating heavy and light ions respectively, a spectrometer magnet (SP1, SP2) for selecting heavy ion species of one isotopic configuration positioned downstream of each ion source (ECRIS 1, ECRIS2);

a magnetic quadrupole triplet (QT1, QT2) positioned downstream of each analyzing slit (SP1, SP2);

an analyzing slit (ISL) located at an image focus of each spectrometer magnet (SP1, SP2);

beam diagnostic means (BD) located at each slit (SL, ISL) comprising at least profile grids and Faradays cups;

a switching magnet (SM) for switching between high-LET ion species and low-LET ion species of said two independent first and second ion source; and a radio frequency quadrupole accelerator (RFQ) positioned downstream said switching magnet (SM) wherein a beam transformer (BTR) is positioned in between said analyzing slit (ISL) and said magnetic quadrupole triplet (QT1; QT2);

said ion sources (ECRIS1, ECRIS2) comprise exclusively permanent magnets and said RFQ has a 4-rod-like structure comprising alternating stems (ST) mounted on a common base plate (BP) within the RFQ, wherein said stems (ST) are acting as inductivity and mini-vane pair forming electrodes (EL) and are acting as capacitance for a $\lambda/2$ resonance structure.

2. The apparatus according to claim 1, wherein a solenoid (SOL) magnet is located at an exit of each ion source (ECRIS1, ECRIS2).

3. The apparatus according to claim 1 wherein a magnetic quadrupole singlet (QS1, QS2) is positioned downstream of each ion source (ECRIS1, ECRIS2).

4. The apparatus according to claim 1, wherein a focusing solenoid magnet (SOL) is positioned downstream of a chopper (CH) and upstream of said radio frequency quadrupole (RFQ) accelerator.

5. The apparatus according to claim 1, wherein the low energy beam transport system (LEBT) comprises downstream of the switching magnet (SM) diagnostic means (F01, F02) enclosing a Faraday cup and/or profile grids.

6. The apparatus according to claim 2, wherein a magnetic quadrupole singlet (QS1, QS2) is positioned downstream of each ion source (ECRIS1, ECRIS2).

* * * * *